United States Patent [19]

Yamada et al.

[11] 4,316,237

[45] Feb. 16, 1982

[54] LIGHTING FIXTURE FOR USE IN MEDICAL OPERATIONS AND THERAPEUTIC TREATMENT

[75] Inventors: Isao Yamada; Mitsuyuki Ikeda; Yumiko Komori, all of Tokyo, Japan

[73] Assignee: Yamada Iryo Shomei Kabushiki Kaisha, Tokyo, Japan

[21] Appl. No.: 134,580

[22] Filed: Mar. 27, 1980

[30] Foreign Application Priority Data

Jun. 11, 1979 [JP] Japan ..... 54-78336[U]
Sep. 26, 1979 [JP] Japan ..... 54-132007[U]

[51] Int. Cl.[3] ..... F21V 19/02; F21S 1/14

[52] U.S. Cl. ..... 362/33; 362/232; 362/233; 362/250; 362/282; 362/283; 362/371; 362/372; 362/428; 362/804

[58] Field of Search ..... 362/33, 232, 233, 250, 362/282, 283, 371, 372, 428, 804

[56] References Cited

U.S. PATENT DOCUMENTS

| | | | |
|---|---|---|---|
| 1,277,110 | 8/1918 | Patterson | 362/267 |
| 2,173,325 | 9/1939 | Alexander | 362/267 |
| 2,827,554 | 3/1958 | Gunther et al. | 362/33 |
| 3,225,184 | 12/1965 | Reiber | 362/233 |
| 3,491,230 | 1/1970 | Lory | 362/233 |
| 3,786,244 | 1/1974 | Hutter | 362/33 |
| 3,887,801 | 6/1975 | Ilzig et al. | 362/233 |
| 4,025,777 | 5/1977 | Hayakawa | 362/250 |

*Primary Examiner*—Benjamin R. Padgett
*Assistant Examiner*—Irwin Gluck
*Attorney, Agent, or Firm*—Wenderoth, Lind & Ponack

[57] ABSTRACT

A lighting fixture for use in therapeutic treatment having a lamphousing with a plurality of lamps located therein which are simultaneously moved within the lighting fixture lamp housing for adjusting the focal point of the lamps by moving a single control handle which is also used to adjust the position of the lamp housing itself. The single control handle is detachable so that it can be sterilized and thereby allowing for sterile conditions to be maintained each time the lighting fixture is used.

7 Claims, 9 Drawing Figures

LIGHTING FIXTURE FOR USE IN MEDICAL OPERATIONS AND THERAPEUTIC TREATMENT

BACKGROUND OF THE INVENTION

The present invention is directed to a lighting fixture for use in medical operations and therapeutic treatment. More particularly, the present invention is directed to such a lighting fixture which has a plurality of individual lamps arranged within a lamp housing and which is capable of having the focus thereof adjusted. The present invention permits adjustment of the position of the lamp housing and the focal point of the lamps to be simultaneously done by a simple single manipulation of the lighting fixture by means of a single lever. Further, a transformer is located in a balanced position within the housing so that the light intensity of each lamp can be adjusted by manipulation of a control lever on the side of the lamp housing.

Previous devices of the above-described type have been inefficient to operate in that an extra person is required to adjust the lighting fixture for the person performing the medical operation or therapeutic treatment. Specifically, devices of the prior art are shown in FIGS. 1 through 3 and are characterized in that they are suspended from a ceiling 1 by an arm 2 which includes three parts so as to be universally movable about the point where it is attached to the ceiling. Further, as shown in the prior art drawings, the lower end of arm 2 has a lamp housing supporting arm 3 attached thereto for tilting about its axis and swinging in the vertical direction.

The supporting arm 3 has a lamp housing 4 attached thereto for tilting which holds a plurality of lamps 5 concentrically arranged therein. At the center is located a step down transformer 6 and a rotating member 7 which covers the transformer 6. The lamps are connected to the periphery of the plate 7 by transmission rods 11 through universal joints 9 and pivot points 10 whereby each lamp 5 can be adjusted by rotation of the rotating plate so that individual beams of light intersect at a desired focal point. A gear 12 is attached to the member 7 and meshes with another gear 15 which is fixedly secured to one end of a rod 14 which extends through, and out the side of the lamp housing with a knob 13 attached to the other end of the rod 14, outside of the lamp housing, for adjusting the lamps 5 as previously described. In prior art type devices, there is also a handle 16 located on the inside and half way down the side of the lamp housing which is used for adjusting the height or angle position of the lamp housing while the knob 13 must be turned to adjust the lamps 5.

Thus, in the conventional lighting fixtures of the kind as previously described, a disadvantage is that there are required two persons to use the lighting fixture since the person who is doing the medical operation or treatment, usually a doctor, must refrain from touching the handle and knob, which may not be sterilized, in order to prevent microbes from entering the area being treated and creating a secondary infection therein.

Other disadvantages inherent in the prior art type devices is that the use of a second person for continually adjusting the lighting fixture results in much time and labor being lost, especially if that person is a nurse and the doctor has to be continually instructing her about the lighting angle and focus to achieve optimum lighting.

If the lighting adjustment by the nurse is not adequate, it may result in unduly tiring the doctor's or treating person's eyes and as a result, the operation or treatment may turn out to be unsuccessful.

Generally two separate adjustments of lighting fixtures of this kind, as described above, are required. The reasons for this are that the lighting fixture must be as compact as possible while at the same time illuminate a specific area with an appropriate intensity light for the particular circumstances for which the lamp is being used. This being the case, a multiple adjustment lamp, i.e. adjustment for intensity, focus and position, cannot be avoided. It therefore becomes very important to combine the position or mechanical adjustment mechanisms into one single mechanism which allows a single person to use the lamp while performing medical operations or therapeutic treatment and which up to now, has not been shown in the prior art.

SUMMARY OF THE INVENTION

An object of the present invention is to provide a lighting fixture having a single adjusting handle for adjusting both the lamp housing position and the focus of the lamps therein so that the desired area of the human body can be quickly and easily illuminated.

Another object of the present invention is to have an adjusting handle which can be quickly mounted and dismounted from the lamp housing for sterilization purposes so that the person doing the operation or treatment can adjust the lighting fixture himself without creating a risk of causing a secondary infection in the person being treated.

Still another object of the present invention is to provide a compact lamp housing having a single structure lamp intensity adjusting transformer located centrally within the lamp housing which thus balances the housing so that the intensity of each lamp therein can be easily adjusted from the side of the lamp housing and thereby elliminates the requirement of having a complicated mounting of the adjusting transformer in one of the walls of the room wherein the lighting fixture is being used.

The present invention thus discloses a multiple lamp lighting fixture for use in therapeutic treatment which has a single adjusting mechanism capable of both, adjusting the position of the lamp housing and adjusting the focus of the lamps therein, and which has a removable handle mounted thereon capable of being removed to be sterilized. The person performing the operation then is capable of positioning the lamp housing and adjusting the focus of the lamps and the intensity thereof himself.

BRIEF DESCRIPTION OF THE DRAWINGS

These and other objects and advantages of the present invention will become more apparent from the following detailed description made with reference to the accompanying drawings in which:

FIG. 8(*b*) is an upper end view of the adjusting handle of the present invention.

DETAILED DESCRIPTION OF THE INVENTION

Figure 1:
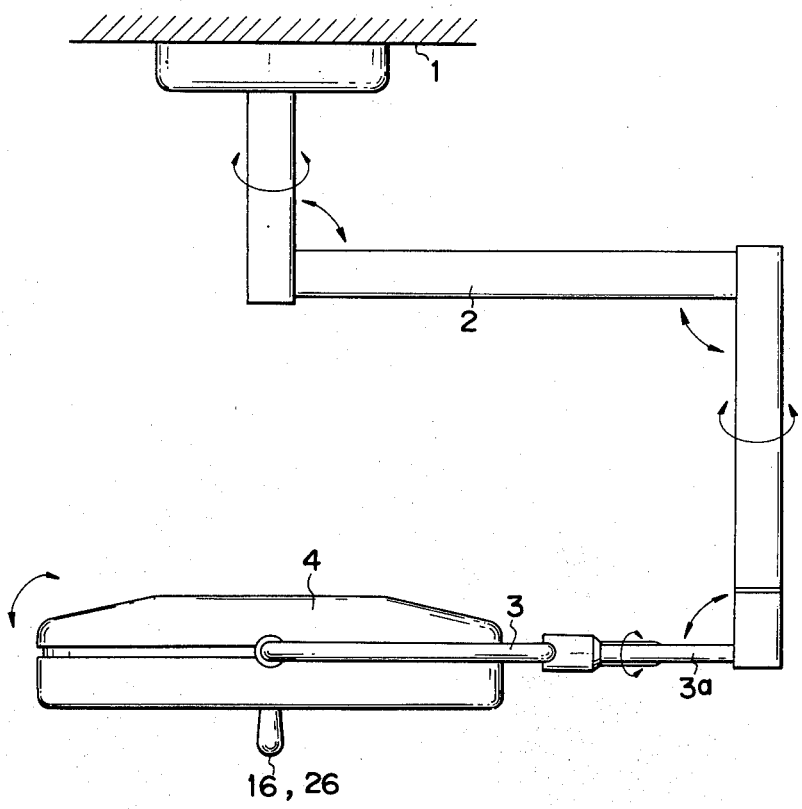
FIG. 1 is a side view of a lighting fixture as known in the prior art and which shows various elements in common with the present invention.

As shown in FIG. 1, a lamp housing hanging arm 2 is attached to the ceiling 1 of a room in a manner which allows a lamp housing to swing or move vertically with respect thereto.

The lower end of the lamp housing hanging arm 2 has the base 3*a* of a lamp housing supporting arm 3 attached thereto. The lamp housing 4 is tiltably attached to the lamp housing supporting arm 3 and a number of lamps 5 are concentrically arranged and supported within the lamp housing 4 in a manner such that they can be tilted in a radial direction with respect to the central axis of the lamp housing 4.

There is an opening 17 which is centrally located on a bottom wall 4*a* which is positioned midway down the side of and inside the lamp housing 4. Further, a sleeve 19 having a reinforcing member 18 is located inside the lamp housing 4 and on top of wall 4*a*, and engaging hook fitting member 20, having holes 18*a*, 19*a* and 20*a* located therein, is positioned outside the lamp housing 4, and is integrally attached to sleeve 19 and member 18, and further, is secured to the lamp housing's lamp housing bottom wall 4*a* at opening 17 by means of screws 21.

A wall of sleeve 19 has a stepped portion 19*b* receiving an outer ring of a bearing 23 located within hole 19*a*. Further, referring to FIG. 6, bearing 23 contacts flange 22*a* which is located halfway down central focus adjusting shaft 22.

A rotatable housing 24, which is made of electrically insulating material is located on top of the flange 22*a* and is attached to flange 22*a* by screws 25 with the shaft 22 extending down through the central axis of the housing 24 and being held therein by flange 22.

The transformer mount 28 is held by shaft 22 within housing 24 and has integral therewith, a tubular portion 28(*a*) which has a stepped portion 28(*b*) for attaching the transformer mount 28 to the shaft 22 by means of a bearing 29 which is located within the stepped portion 28(*b*).

A step down transformer 30 is mounted on the transformer mount 28 and insulated therefrom by means of insulators 31 and 33. Transformer securing plate 32 is attached to the top portion of the transformer mount 28 by means of nut 34, and serves to securely hold the transformer 30 thereon.

There are three equally spaced legs 35 attached to the underside of the transformer mount 28 which extend through slots 36 in the bottom of housing 24 and are secured to sleeve 19.

Figure 7:
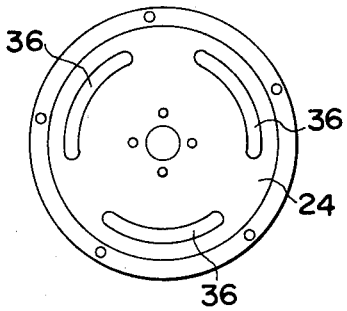
FIG. 7 is a bottom view of the rotating transformer housing which also holds the central focus adjusting shaft of the present invention.

As shown in FIG. 7, the bottom side of housing 24 has slots 36 therein for guiding the legs 35 and permitting rotation of housing 24 with the ends of the slots operating as stops for limiting the range of rotation of housing 24.

The tips of engaging hooks 37 jut inward into hole 20(*a*) with the hooks 37 being located within engaging hook fitting member 20, from four directions. Engaging hooks 37 have a tapered tip 37*a* which extends into the hole 20(*a*) in a longitudinally transverse direction, with the remainder of the engaging hook 37 being located in a hook-setting hole 38. The tapered tip 37*a* is urged into the hole 20*a* by a spring 39 which is held in hook-setting hole 38 by a screw 40 as shown in FIG. 6.

Figure 6:
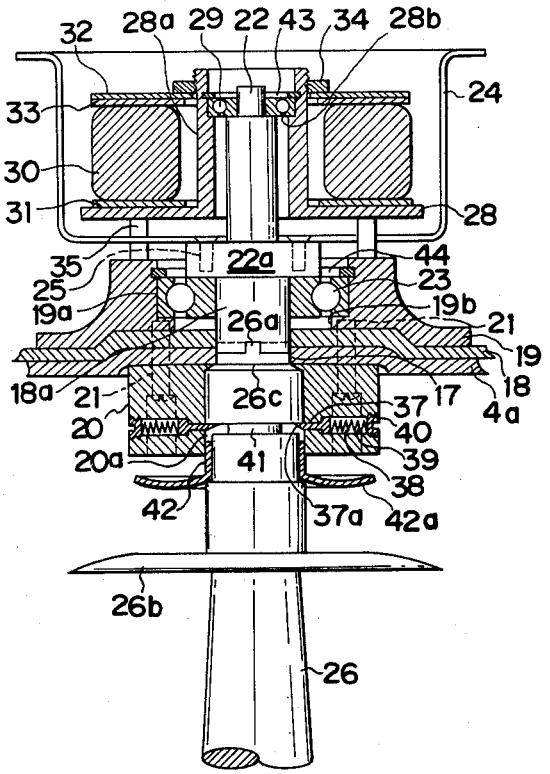
FIG. 6 is a detailed view of the mounting mechanism and transformer housing of the removable handle of the present invention.
Figure 8:
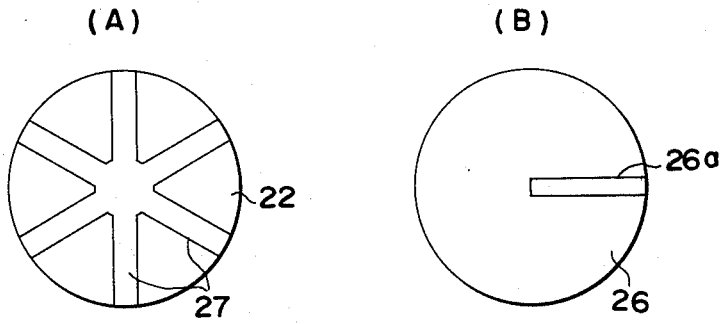
FIG. 8(*a*) is a lower end view of the central focus adjusting shaft of the present invention.

As described previously, handle 26 has a ridge 26*a* which extends in the radial direction relative to the handle as shown in FIGS. 6 and 8(*b*) for engaging a groove 27, on the focus adjusting shaft 22 as shown in FIG. 8(*a*).

The upper end of handle 26 has a tapered portion 26*c* which is engaged by the tapered portion 37*a* of hook 37 so that when the handle 26 is inserted into hole 20*a* the hooks 37 are compressed in against the springs 39 for latching the handle 26 and holding it securely.

The handle has an annular groove 41 for receiving the hook 37 and which thereby serves to hold the handle securely on the lamp housing and connected to shaft 22. There is also a hook disengaging member 42 which is located under the annular groove 41 for causing the engaging hooks 37 to recede into the holes 38. The member has hand engaging portion 42*a* for forcing it to move upward into contact with the tapered hook portion 37*a* by the person using the lighting fixture for accomplishing the previously described disengaging operation.

FIG. 6 shows the flange 26*b* of the handle 26 and further, shows C-rings 43 and 44 serve to lock the handle receiving assembly together.

There is a voltage regulator 45 located attached to the side wall of the lamp housing 4 and which has a knob 46 which is turned for stepping down the voltage of transformer 30 and thereby adjust the intensity of each of the lamps 5. The knob is electrically connected to the terminal 47 of the transformer 30 by a cord 48.

Figure 5:
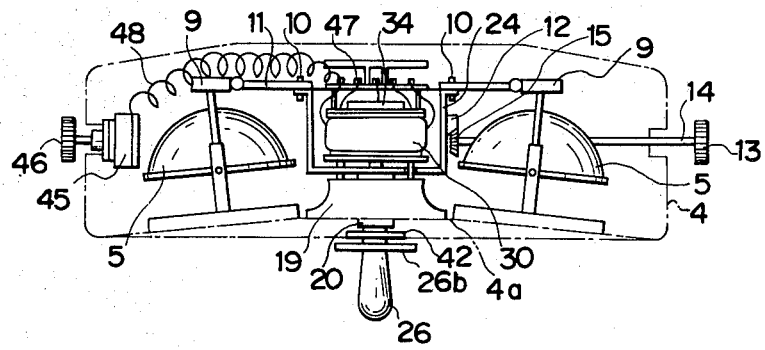
FIG. 5 is a side view of the lamp housing of the present invention which shows the principal elements of the present invention.
Figure 2:
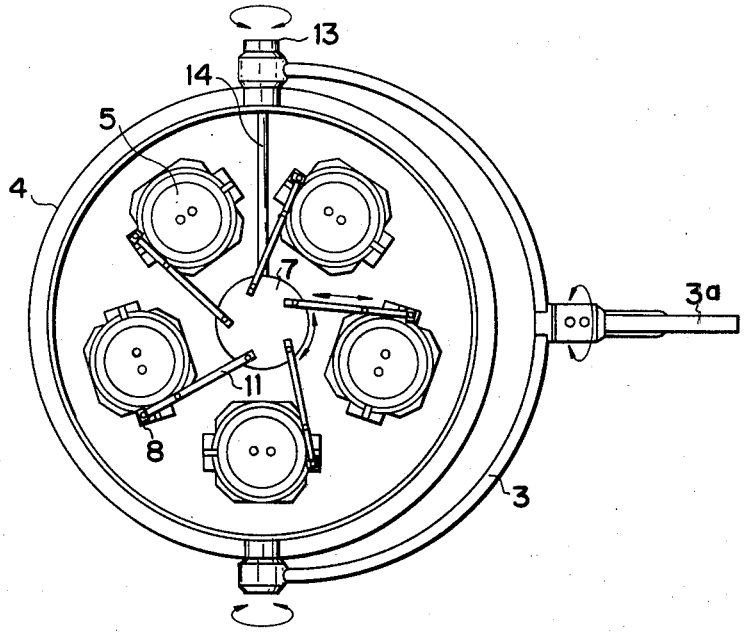
FIG. 2 is a plan view of a prior art lamp housing with the lamp housing cover removed and which shows some elements in common with the present invention.
Figure 3:
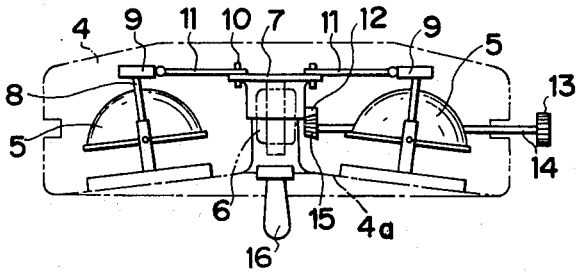
FIG. 3 is a side view of a prior art lamp housing which shows various elements in common with the present invention.
Figure 4:
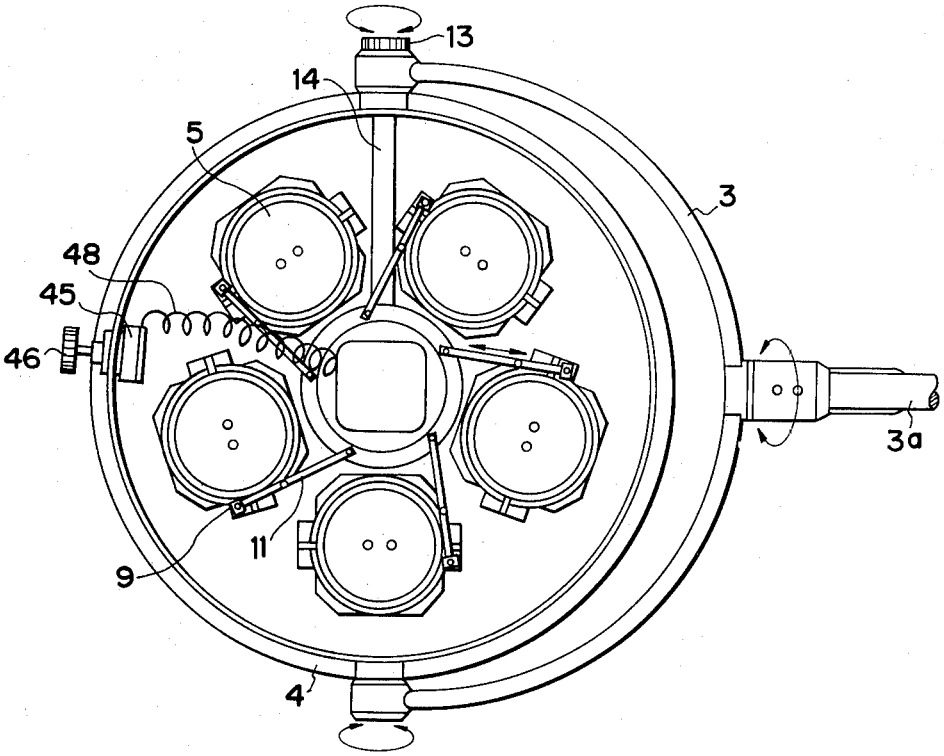
FIG. 4 is a plan view of the lamp housing of the present invention having its cover removed.

The rotating housing 24 has a rack 12 which is attached thereto, as shown in FIG. 5. Further, rack 12 meshes with pinion 15, which is concentrically attached, about the pivotal axis of the lamp housing supporting arm 3 about which the lamp housing 4 is pivoted, to the inner end of focus adjusting rod 14 with focus adjusting knob 13 being attached to the other end of rod 14 outside of the lamp housing 4.

By way of example, the operation of one embodiment of the present invention will be described.

Before using the lighting fixture, the handle 26 is sterilized and then inserted into hole 20*a* of hook fitting member 20. The hook 37 overcomes the force being exerted on it by spring 39 as a result of being engaged by tapered portion 26*c* of the handle, and is thereby forced into the hook setting hole 38.

As the handle 26 is further inserted, the top portion comes into contact with and is connected to focus adjusting shaft 22 as hook 37 is forced, by spring 39, into engagement with the handle by jutting into groove 41.

By thus attaching handle 26 to the lamp housing 4, the lamp housing 4 position and the focus of each lamp 5 can be adjusted by a mere manipulation of the handle 26. The position of the various parts of the fixture which is controlled by handle 26 are adjusted as described above and the focus adjusting shaft 22 and the rotatable housing 24 are turned to thus cause each drive rod 11 to tilt the lamps 5 respectively, in a radial direction and thus change the focus thereof. Likewise, if the illumination on the area being treated is not correctly focused, the doctor can order this assistant to turn focus adjusting knob 13 which is also used to adjust the lamps 5.

Thus, as knob 13 is turned, the housing 24 is caused to turn in the same way as when handle 26 is turned, by turning the lateral focus adjusting shaft 14 and the rack and pinion 12 and 15, so that each lamp 5 is tilted by the rods 11 in a radial direction with respect to the central axis of the lamp housing 4.

Further, if the light intensity on the treated area is either insufficient or too great, the adjusting knob 46 is turned, thus lowering the terminal voltage of transformer 30 by adjusting the setting of voltage regulator 45. If knob 46 is not sterilized, care should be taken that adjustment be done by another person other than the doctor.

To remove the handle 26 from the lamp housing, the operator's finger is placed on flange **26*b* of disengaging piece 42 to force disk 42*a* upward. This action forces the hook 37 into hole 38 so that handle 26** may be removed.

There are various modifications which can be made to the transformer to modify the shape of the fixture. For example, the transformer may be either annular or boxlike in shape. An annular shape would allow construction of a very thin lamp housing. Likewise, the transformer may be fixedly secured to the transformer housing so as to be rotatable together with the transformer housing. It is however, advisable to support the transformer in a stationary manner and thus avoid the possibility of snapping the power supply cord to the transformer.

The central focus adjusting shaft can be either fixed to the center of the bottom of the transformer housing or can extend therethrough to the top of it. From the standpoint of safety however, it is desirable to support said shaft at both the bottom and the upper end of the transformer housing.

With the invention as thus described, the doctor can position the lamp housing and adjust its focus himself. Thus, optimum lighting for treatment of an affected area can be quickly and reliably achieved even in complicated or time consuming operations. The described feature provides the additional advantage of reducing eye fatigue in the doctor doing the treatment. Further, an assistant which is normally used for the sole purpose of adjusting the lamp position and focal depth can be eliminated and thus resulting in greater efficiencies. Still further, the operation of the lighting fixture is very convenient because the positioning of the lamp housing and the adjustment of the focus of each lamp can be done through manipulation of a single handle.

Since the transformer is housed at the center of the lamp housing, the lamp housing is well balanced and can be adjusted in a smooth and natural fashion. Further, since the intensity control of the lamps is located on the side of the lamp housing, there is no requirement of sending an assistant to the wall for adjusting the intensity of the lamp. Instead, the doctor can easily instruct the assistant while viewing the illuminated area. Finally, the installation of a rack around the rotatable transformer housing which meshes with a pinion which is installed at the internal end of a lateral focus adjusting shaft having a focus adjusting knob on the outside of the lamp housing allows for the focal depth to be changed by a person other than the doctor. Thus, two separate people can adjust the focal depth at different times while the handle which is used by the doctor for adjusting said depth is maintained in a sterilized condition throughout the treatment.

Having thus described the invention, the scope of the invention will be defined in the following in which:

What is claimed is:

1. A multiple lamp lighting fixture for use in therapeutic treatment, said lighting fixture comprising:

(a) lamp housing supporting means having a lamp housing tiltably attached thereto for supporting said lamp housing thereon and allowing movement of said lamp housing relative to said lamp housing supporting means;

(b) a plurality of lamps mounted concentric to the vertical axis of said lamp housing within said lamp housing, said lamps being adjustable with respect to the vertical axis of said lamp housing;

(c) a centrally located focus adjusting shaft vertically secured along the central axis of said lamp housing within said lamp housing;

(d) a rotatable transformer housing having said focus adjusting shaft running vertically through the center thereof and being attached to said focus adjusting shaft;

(e) a plurality of drive rods connecting said rotatable transformer housing to corresponding ones of said lamps for simultaneously tilting said lamps to focus light beams which are emitted by said lamps along the central axis of said lamp housing when said transformer housing is rotated;

(f) a manipulating handle having engagement means for being detachably attached to said focus adjusting shaft for rotating said transformer housing and thereby causing said plurality of lamps within said lamp housing to tilt; and (g) a transformer mounted within said transformer housing, said transformer having a voltage regulator connected thereto and said voltage regulator having a control knob connected thereto and mounted on the outside of said lamp housing for controlling the light intensity of said plurality of lamps.

2. A lighting fixture as claimed in claim 1 wherein said engagement means comprises: rotation restricting means attached to said manipulating handle and said focus adjusting shaft for causing said focus adjusting shaft and handle to rotate simultaneously, hook means and hook receiving means connected between said shaft and said handle, detachably mounting said manipulating handle to said focus adjusting shaft; and hook disengaging means for disengaging said hook receiving means from said hook means for detaching said manipulating handle from said focus adjusting shaft.

3. A lighting fixture as claimed in claim 1 or 2 wherein said focus adjusting shaft has a flange extending therefrom and said lamp housing has a sleeve surrounding said focus adjusting shaft at the position whereat said focus adjusting shaft is vertically fixed to said horizontally extending wall for preventing vertical movement of said shaft, and said flange has the upper surface thereof secured to said transformer housing.

4. A lighting fixture as claimed in claim 3 wherein said transformer housing has a supporting member located therein and said transformer is supported on said supporting member, said supporting member having legs and said transformer housing having slots in the bottom thereof, said legs extending through said slots and being fixed to said sleeve for allowing rotation of said transformer housing over a specific range.

5. A lighting fixture as claimed in claim 4 wherein said supporting means has a tubular member located around the center portion thereof and said focus adjusting shaft has a top bearing connecting the top end of said focus adjusting shaft with said tubular member.

6. A lighting fixture as claimed in claim 1 or 2 wherein said transformer has an annular shape.

7. A lighting fixture as claimed in claim 1 or 2 further comprising:

a transformer housing rack attached to the outside of said transformer housing;

a lateral focus adjusting rod extending through said lamp housing to the outside of said lamp housing and having a knob attached thereto on the outside of said lamp housing for turning said rod; and a pinion attached to the inner end of said rod and engaged by said transformer housing rack for causing said transformer housing to rotate when said rod is rotated, thereby tilting said plurality of lamps when said rod is turned by turning said knob.

* * * * *